US006672711B2

(12) United States Patent
Kao et al.

(10) Patent No.: US 6,672,711 B2
(45) Date of Patent: Jan. 6, 2004

(54) DRIVING CIRCUIT CAPABLE OF MAINTAINING HEAT EQUILIBRIUM OF A PRINT HEAD NOZZLE

(75) Inventors: Chih-Hung Kao, Taipei (TW); Yu-Fan Fang, Taipei (TW)

(73) Assignee: BenQ Corporation, Tao-Yuan Hsien (TW)

( * ) Notice: Subject to any disclaimer, the term of this patent is extended or adjusted under 35 U.S.C. 154(b) by 96 days.

(21) Appl. No.: 09/682,186

(22) Filed: Aug. 2, 2001

(65) Prior Publication Data

US 2002/0018086 A1 Feb. 14, 2002

(30) Foreign Application Priority Data

Aug. 4, 2000 (TW) ..... 89115675 A

(51) Int. Cl.[7] ..... B41J 2/05

(52) U.S. Cl. ..... 347/60; 347/11; 347/17; 347/185

(58) Field of Search ..... 347/12, 9, 11, 347/40, 60, 128, 144, 185, 196, 14, 17, 180, 181, 182

(56) References Cited

U.S. PATENT DOCUMENTS 4,746,935 A * 5/1988 Allen ..... 346/140
4,982,199 A * 1/1991 Dunn ..... 346/1.1
5,107,276 A 4/1992 Ladonna et al.
5,172,134 A * 12/1992 Kishida et al. ..... 346/1.1
5,475,405 A * 12/1995 Widder et al. ..... 347/14
5,774,137 A 6/1998 Yoshida
5,992,979 A * 11/1999 Barbour et al. ..... 347/60
6,145,948 A * 11/2000 Kishida et al. ..... 347/13
6,257,691 B1 * 7/2001 Iwasaki et al. ..... 347/15
6,270,180 B1 * 8/2001 Arakawa et al. ..... 347/14
6,310,636 B1 * 10/2001 Tajika et al. ..... 347/14

FOREIGN PATENT DOCUMENTS

| | | | |
|---|---|---|---|
| DE | 69516356 | T2 | 9/2000 |
| EP | 0627313 | A2 | 12/1994 |
| EP | 0955165 | A2 | 11/1999 |
| JP | 03246049 | A | 11/1991 |

* cited by examiner

*Primary Examiner*—John Barlow
*Assistant Examiner*—Lam Nguyen
(74) *Attorney, Agent, or Firm*—Winston Hsu

(57) ABSTRACT

A driving circuit drives an ink jet print head in a printing device. The ink jet print head has ink jet cells and heating elements corresponding to the ink jet cells. The driving circuit has a driving signal generator that provides two different driving signals to heat the ink jet cells. The first driving signal heats cells intended for jetting ink with sufficient energy so that they do jet ink. The second driving signal heats cells not intended for jetting ink with insufficient energy so that they are heated without jetting ink.

14 Claims, 12 Drawing Sheets

DRIVING CIRCUIT CAPABLE OF MAINTAINING HEAT EQUILIBRIUM OF A PRINT HEAD NOZZLE

BACKGROUND OF INVENTION

1. Field of the Invention

The present invention relates to a driving circuit of an ink jet print head in a printing device, and more particularly, to a driving circuit that balances thermal energy among heating elements of ink jet print cells.

2. Description of the Prior Art

Please refer to FIG. 1. FIG. 1 is a diagram of a prior art ink jet print head 70. The ink jet print head 70 comprises an ink tank 72, a plurality of channels 74, and a plurality of ink jet cells 76. The ink tank 72 connects to the plurality of ink jet cells 76 through the plurality of channels 74. Ink in the ink tank 72 can flow into the ink jet cells 76 through the channels 74. A heating resistor 78 is installed alongside each inkjet cell 76. The heating resistor 78 heats up ink in the ink jet cells 76. The plurality of heating resistors 78 form a heating circuit 60, as shown in FIG. 2. When the heating resistor 78 has energy greater than a threshold, bubbles 80 are generated in the ink. The bubbles force ink drops to jet from the nozzles 82 onto the medium (such as paper) to perform printing. However, the amount of ink jetted out is related to the energy supplied by the heating resistors 78. So, if higher energy is supplied, larger ink drops are jetted out and larger ink spots are formed on the medium. If lower energy is supplied, smaller ink drops are jetted out and smaller ink spots are formed on the medium. If the sizes of the ink drops are not uniform or within a limited range, the printing quality is low. Therefore, the energy generated by the heating resistors 78 should be higher than the threshold so as to jet ink drops, and should also be maintained within a limited range so as to form ink drops of substantially equal sizes.

FIG. 2 is a diagram of a prior art ink jet print head driving circuit 10. The driving circuit 10 comprises a row driving module 20 and a column driving module 40. The row driving module 20 receives row data 30 and passes four row control signals R1, R2, R3, R4 to the heating circuit 60 in the ink jet print head. The column driving module 40 receives column data 50 and passes four column control signals C1, C2, C3, C4 to the heating circuit 60 in the ink jet print head. The row driving module 20 comprises a shift register 22, a latch circuit 24, and a starter 27. The column driving module 40 comprises a shift register 42, a latch circuit 44, and a starter 47. The row driving module 20 and the column driving module 40 use a common clock signal 32, a latch signal 34, and a start signal 39.

The shift registers 22 and 42, controlled by the clock signal 32, receiving binary printing data from the printing device. Then, the latch circuits 24 and 44 latch and store the printing data according to the latch signal 34. The starters 27 and 47 are composed of a plurality of AND gates 37. Each of the plurality of AND gates 37 is connected at one input to an output of a corresponding latch circuit 24, 44. Another input of the AND gate 37 is connected to the start signal 39. According to the start signal 39 and content of the latch circuits 24, 44, the starters 27 and 47 cause the heating circuit 60 in the ink jet print head to start to heat the plurality of ink jet cells. The heating circuit 60 comprises a plurality of row and column data lines arranged in an array. Each row data line and column data line is connected by a heating resistor and a transistor switch, which are respectively controlled by row control signals R1, R2, R3, R4 and column control signals C1, C2, C3, C4. The row control signals R1, R2, R3, R4 are respectively connected to the drains of the transistor switches via resistors, and the column control signals C1, C2, C3, C4 are respectively connected to the gates of the transistor switches. When a specific column and a specific row data line are activated at the same time, the transistor corresponding to the activated row and column data lines conducts, so that current flows through the corresponding heating resistor, and the corresponding ink jet cell jets ink drops.

FIG. 3 is a timing diagram of a prior art ink jet print head driving signal. FIG. 3 illustrates the method of driving the prior art ink jet print head. Between times T0 and T1, four row data 30 and four column data 50 are sequentially input to the shift registers 22 and 42, according to the clock signal 32. When a pulse is generated in the latch signal 34, binary bits of the four row data 30 and the four column data 50 are respectively latched and stored in the latch circuits 24 and 44. The row data 30 and the column data 50 now appear at one input of the AND gates 37 of the starter 27. Between times T1 and T2, a pulse is generated in the start signal 39. Thus, according to the data appearing at the inputs of the AND gates 37 of the starter 27, the outputs of the AND gates 37 go high. For example, if between times T0 and T1, the row data 30 (R1,R2,R3,R4) equals to (1, 0, 0, 0), and the column data 50 (C1,C2,C3,C4) equals to (1, 0, 1, 0), then between times T1 and T2, when the pulse of the start signal 39 generates, the row data line RI and the column data lines C1 and C3 are activated. Therefore, the transistors 62 and 64 conduct, causing current to pass through the heating resistors 66 and 68, so that the corresponding ink jet cells are heated and jet ink. Please note that, because other un-activated transistors do not conduct, current does not pass through the corresponding heating resistances, and the corresponding ink jet cells are not heated.

The size of the ink spot jetted from the ink jet cell is an important factor influencing printing quality. The size of the ink spots is related not only to the energy supplied by the heating resistors, but is also related to whether the ink jet cells have been heated in a previous time. More specifically, if an ink jet cell has been heated to jet ink recently, energy accumulation results in jetting larger ink spots in a new ejection. In other words, if heating a previously unheated ink jet cell and a previously heated ink jet cell with a same energy, ink spots of the former are smaller, and ink spots of the latter are larger. Therefore, if heating the ink jet print head with the prior art driving circuit, the jetted ink drops may have varying sizes, which results in poorer printing quality.

SUMMARY OF INVENTION

It is therefore an objective of the present invention to provide a driving circuit in a printing device that drives heating resistors in a balanced way, so as to improve uniformity of ejected ink spots.

Briefly, the claimed invention provides a driving circuit of an inkjet print head in a printing device. The ink jet print head has a plurality of ink jet cells and corresponding heating elements. Each ink jet cell contains ink and has a nozzle. The driving circuit selectively drives the heating elements to provide energy to the corresponding ink jet cells and to heat the ink jet cells according to printing data from the printing device. The printing data determines whether or not the inkjet cells, and corresponding nozzles, should jet ink. When supplied energy is greater than a threshold, ink drops are jetted from the nozzles onto the medium. The driving circuit has a shift register, a latch circuit, and a driving signal generator. The driving signal generator provides a first driving signal to a first set of nozzles that are expected to jet ink. The first driving signal drives a corresponding first set of heating elements of the first set of nozzles with an energy greater than the threshold to heat a corresponding first set of printing cells, so that ink is jetted from the first set of nozzles. The driving signal generator provides a second driving signal to a second set of nozzles that are expected not to jet ink. The second driving signal drives a corresponding second set of heating elements with an energy less than the threshold, so that a corresponding second set of ink jet cells are heated without jetting ink drops. In this way, the thermal accumulation conditions of different ink jet cells are similar, and the ink jet cells are thus capable of jetting ink drops of uniform sizes to achieve better printing quality.

These and other objectives and advantages of the present invention will no doubt become obvious to those of ordinary skill in the art after having read the following detailed description of the preferred embodiment that is illustrated in the various figures and drawings.

DETAILED DESCRIPTION

Figure 1:
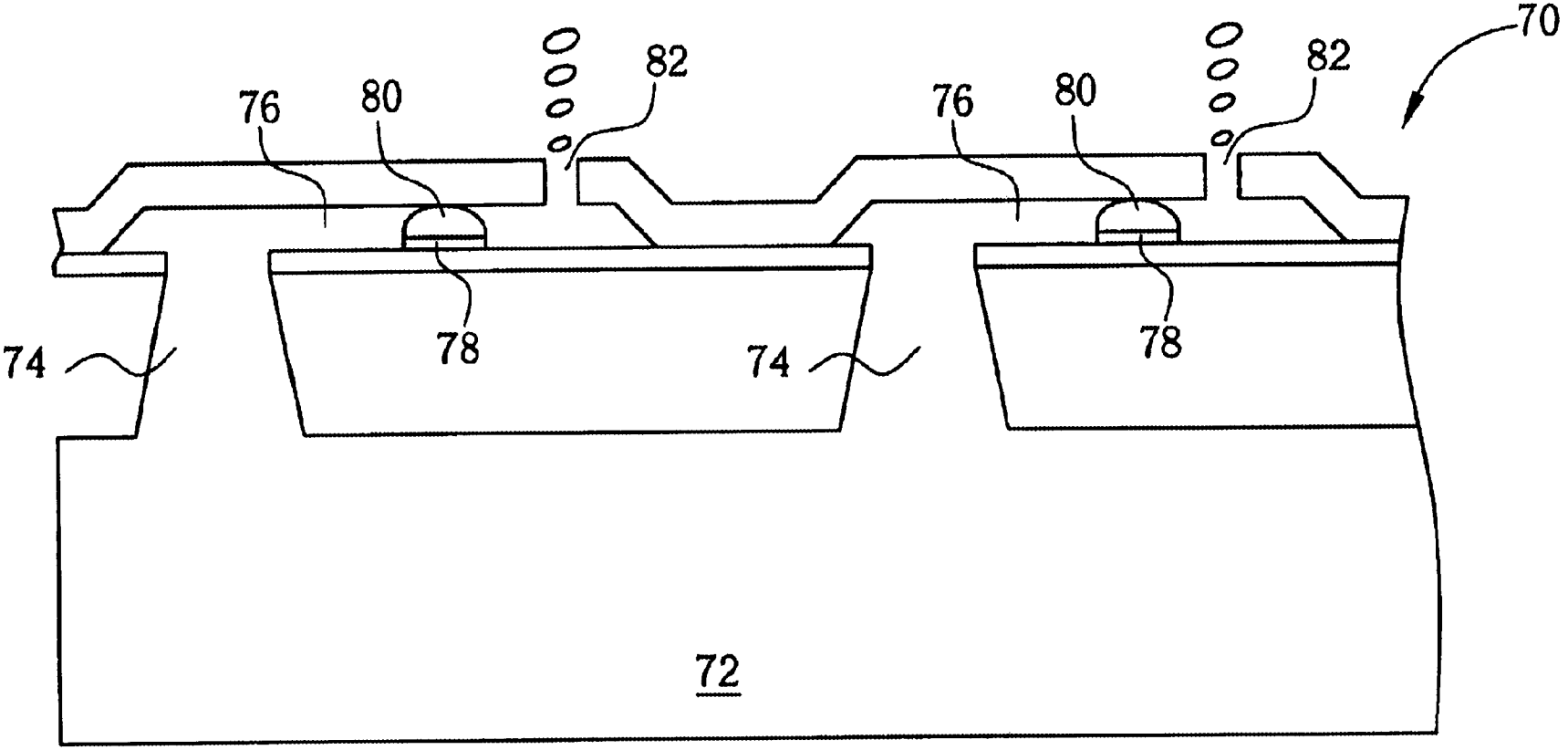
Fig. 1 Prior art
FIG. 1 is a diagram of a prior art ink jet print head.
Figure 2:
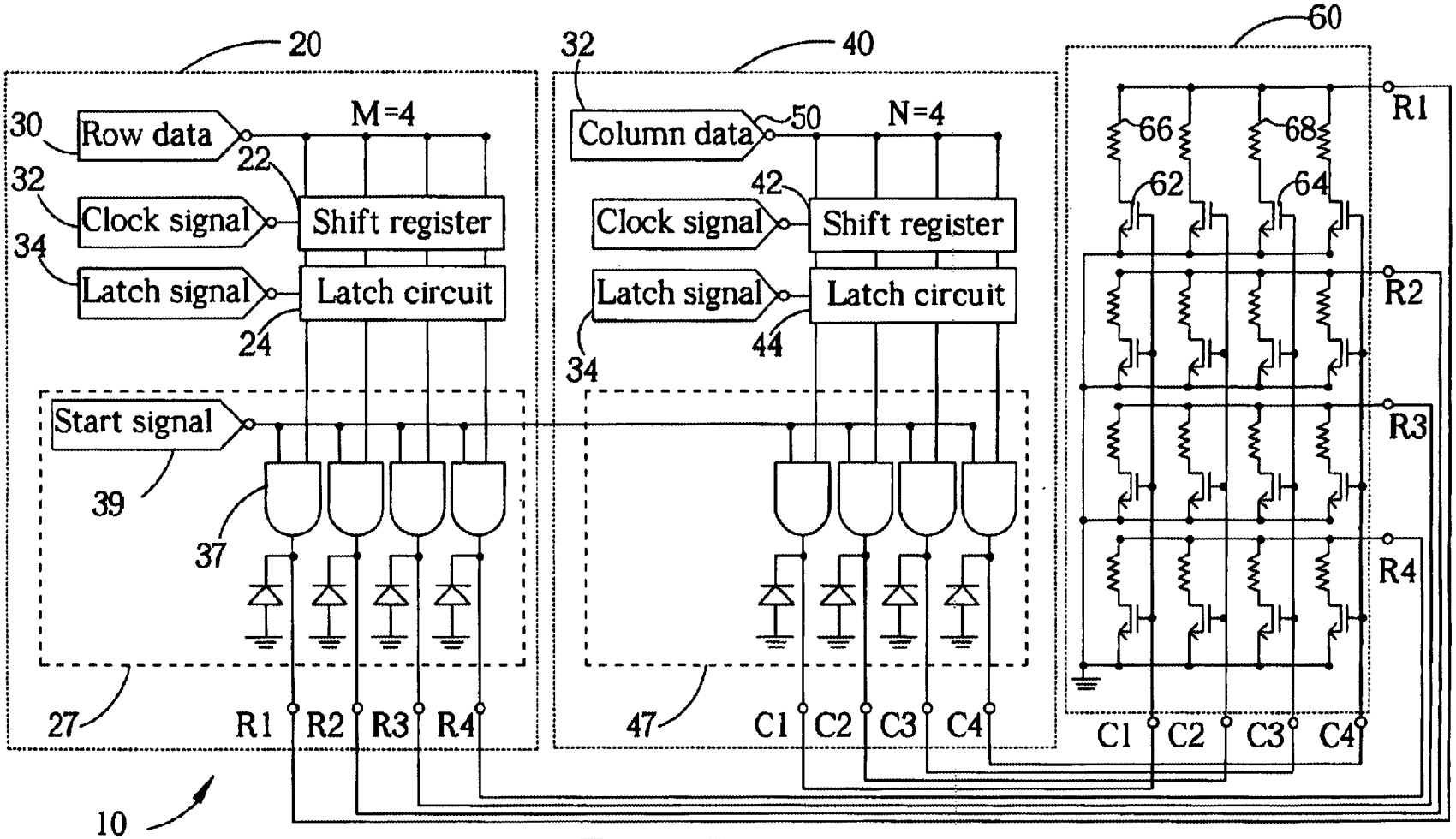
Fig. 2 Prior art
FIG. 2 is a diagram of a prior art ink jet print head driving circuit.
Figure 3:
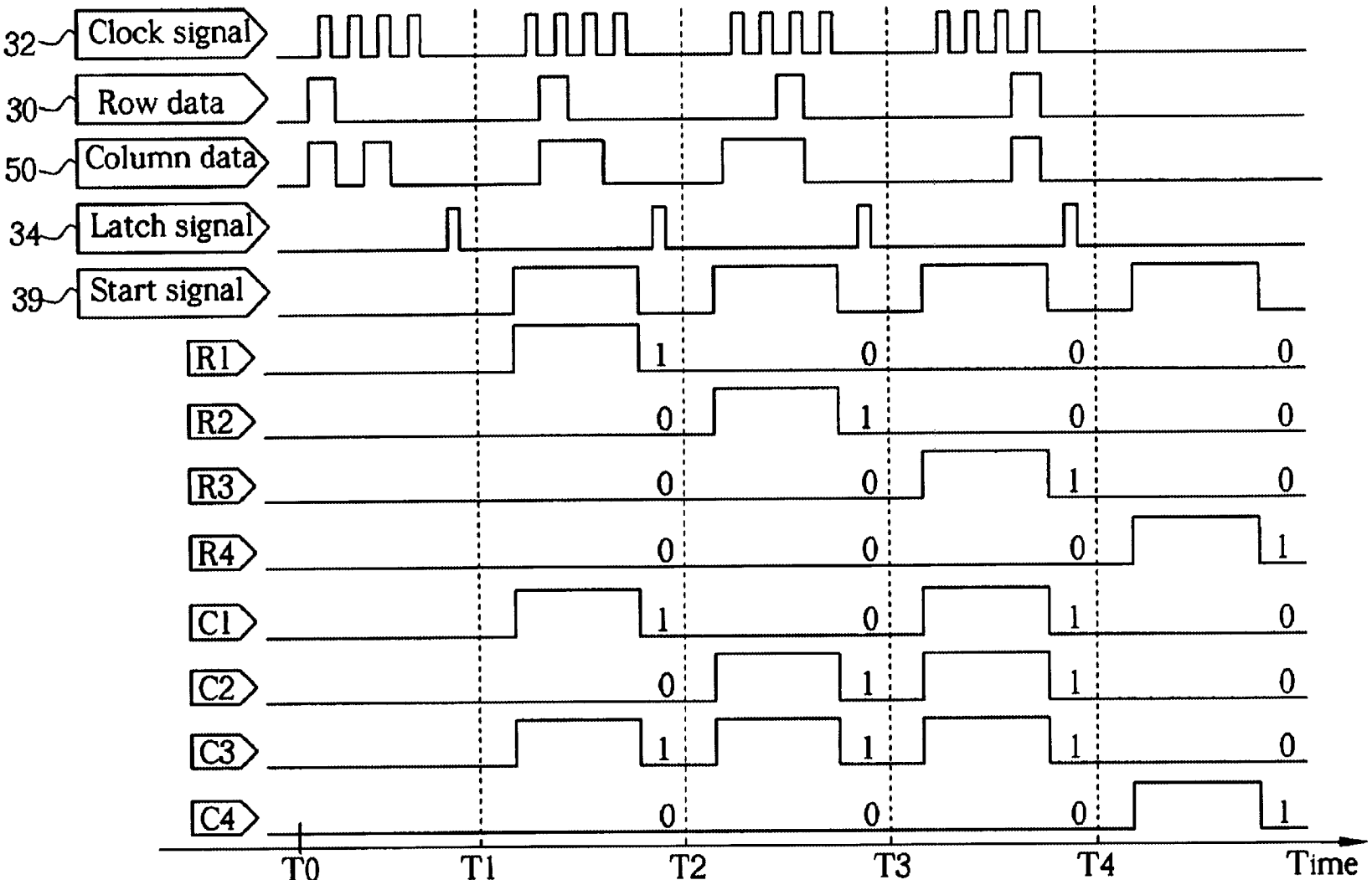
Fig. 3 Prior art
FIG. 3 is a timing diagram of a prior art ink jet print head driving signal.

The present invention improves a driving circuit of an ink jet print head in a printing device. The ink jet print head of the present invention is similar to the prior art ink jet print head in FIG. 1, so a structure of the ink jet print head is not described again. If needed, please refer to the diagram of the ink jet print head in FIG. 1.

Figure 4:
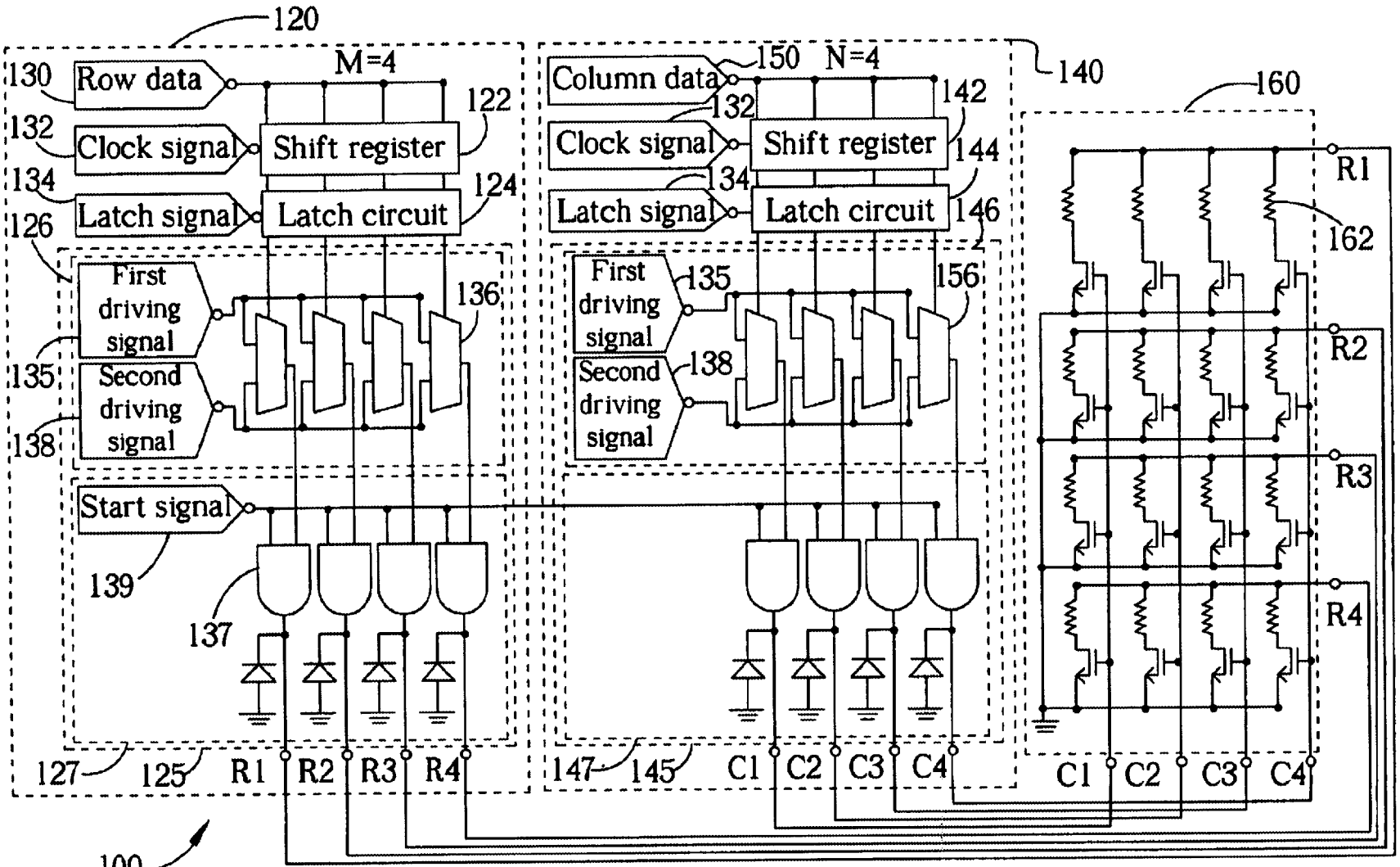
FIG. 4 is a diagram of the first preferred embodiment of the present invention ink jet print head driving circuit.

FIG. 4 is a diagram of a first preferred embodiment of the present invention ink jet print head driving circuit 100. The driving circuit comprises a row driving module 120 and a column driving module 140. For convenience, the present invention takes a 4×4 driving circuit as an example. The row driving module 120 receives row data 130 and passes four control signals R1, R2, R3, R4 to a heating circuit 160 of the inkjet print head. The column driving module 140 receives column data 150 and passes four control signals C1, C2, C3, C4 to the heating circuit 160 of the ink jet print head. The row driving module 120 and the column driving module 140 respectively comprise shift registers 122 and 142, latch circuits 124 and 144, and driving signal generators 125 and 145. The driving signal generator 125 comprises a multiplexer 126 and a starter 127, and the driving signal generator 145 comprises a multiplexer 146 and a starter 147. The row driving module 120 and the column driving module 140 use in common a clock signal 132, a latch signal 134, a first driving signal 135, a second driving signal 138, and a start signal 139.

The shift register 122 is controlled by the clock signal 132 for sequentially receiving printing data transmitted from the printing device. The printing data is transmitted to the shift register 122 in bit form, i.e. digital data of "0" and "1". The latch circuit 124 then latches and stores the printing data according to the latch signal 134. The main function of the driving signal generator 125 is supplying at least two different driving signals according to the printing data. According to the type of the driving signals, the driving signal generator 125 may have different circuit embodiments. For example, in the preferred embodiment, the driving signal generator 125 comprises the multiplexer 126 and the starter 127. The multiplexer 126 comprises four selection units 136. Each selection unit 136 can supply the corresponding first driving signal 135 or second driving signal 138 as an output. The output is selected according to the printing data being 1 or 0. Each multiplexer output connects to one of a plurality of switching elements 137 of the starter 127. The starter 127 causes the heating circuit 160 to start heating the plurality of ink jet cells, according to a start signal 139 that is also connected to the plurality of switching elements 137. The heating circuit 160 in the ink jet print head comprises a plurality of heating elements 162. Each heating element can supply energy to heat the corresponding ink jet cells by the first driving signal 135 or the second driving signal 138, which passes through the starter 127 from the multiplexer 126. The operations of the column driving module 140 are similar to the operations of the row driving module 120, so a detailed description is not provided. Each switching element 137 has two inputs for receiving a signal outputted from a selection unit 136 and a start signal 139. When the start signal 139 is "high", the signal from the corresponding selection unit 136 is transmitted to an output of the switching element 137. That is, the first driving signal 135 or the second driving signal 138 is transmitted to the output of the switching element 137 without a substantial change of its voltage level.

Selection of the first driving signal 135 or the second driving signal 138 depends upon whether or not the inkjet cell is to jet ink. As mentioned above, energy supplied to the nozzles must be greater than the threshold, so that ink can be jetted out from the nozzle. Therefore, when supplying the first driving signal 135, the ink jet cells receive more energy than the threshold, so that the nozzles jet ink. Whereas, when supplying the second driving signal 138, the ink jet cells receive less energy than the threshold, so that the nozzles do not jet ink.

Figure 5:
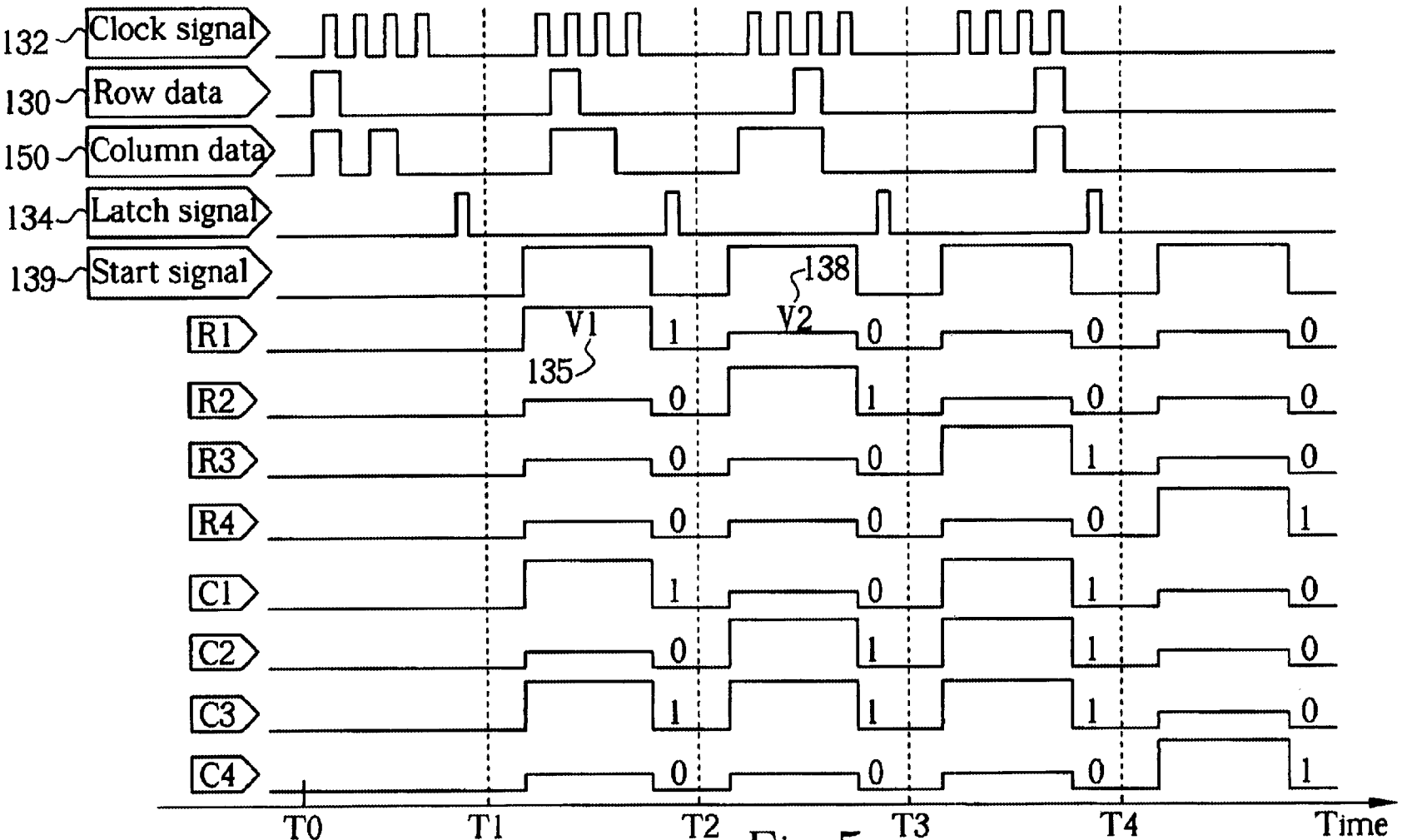
FIG. 5 is a timing diagram of the first preferred embodiment of the present invention ink jet print head driving circuit.

FIG. 5 is a timing diagram of the first preferred embodiment of the present invention ink jet print head driving circuit. Between times T0 and T1, the four row data 130 and the four column data 150 are sequentially input to the shift registers 122 and 142, dependent on the clock signal 132. When the pulse is generated in the latch signal 134, the four row data 130 and the four column data 150 are respectively latched in the latch circuits 124 and 144. The latched data is then output to the selection units 136 and 156 corresponding to the multiplexers 126 and 146. Between times T1 and T2, when the pulse is generated in the start signal 139, the switching elements 137 of the starters 127 and 147 output the corresponding first driving signal 135 or second driving signal 138 to the heating circuit 160 of the ink jet print head. In the preferred embodiment, the first driving signal 135 and the second driving signal 138 are both voltage pulses, and the voltage of the first driving signal 135 is greater than the voltage of the second driving signal 138. Therefore, the energy supplied by the first driving signal 135 is greater than the energy supplied by the second driving signal 138. However, as over against the prior art, the ink jet cells receiving the second driving signal 138 are still heated. Thus, the difference between the thermal energy of the inkjet cell that receives the second driving signal 138 and the thermal energy of the ink jet cell that receives the first driving signal 135 is reduced. Furthermore, the energy received in the second driving signal 138 is not greater than the threshold energy, so the nozzles do not jet ink erroneously.

Figure 6:
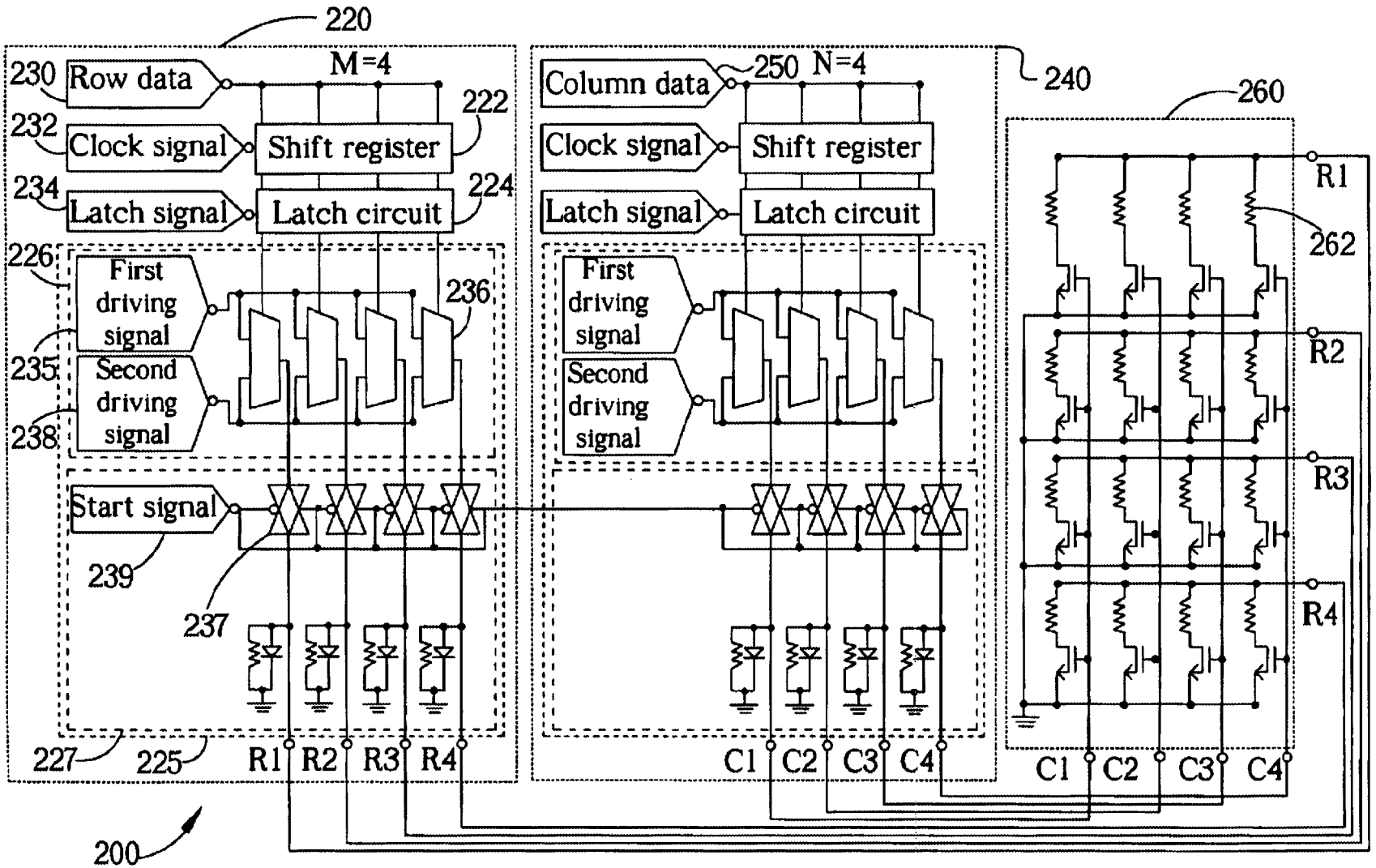
FIG. 6 is a diagram of the second preferred embodiment of the present invention ink jet print head driving circuit.

Please refer to FIG. 6. FIG. 6 is a diagram of a second preferred embodiment of the present invention ink jet print head driving circuit 200. The elements of the driving circuit 200 in FIG. 6 and those of the driving circuit 100 in FIG. 4 are almost the same. The only difference is that the starter 227 of the driving circuit 200 has a plurality of switching elements 237. The switching elements 237 can be designed in BJT or MOS technology. The inputs of each switching element 237 are still the start signal 239 and the output of the corresponding selection unit 236. In other words, functionality of the switching elements 237 of the starter 227 and that of the switching elements 137 of the starter 127 is the same, except that the technology and the elements are chosen differently.

Figure 7:
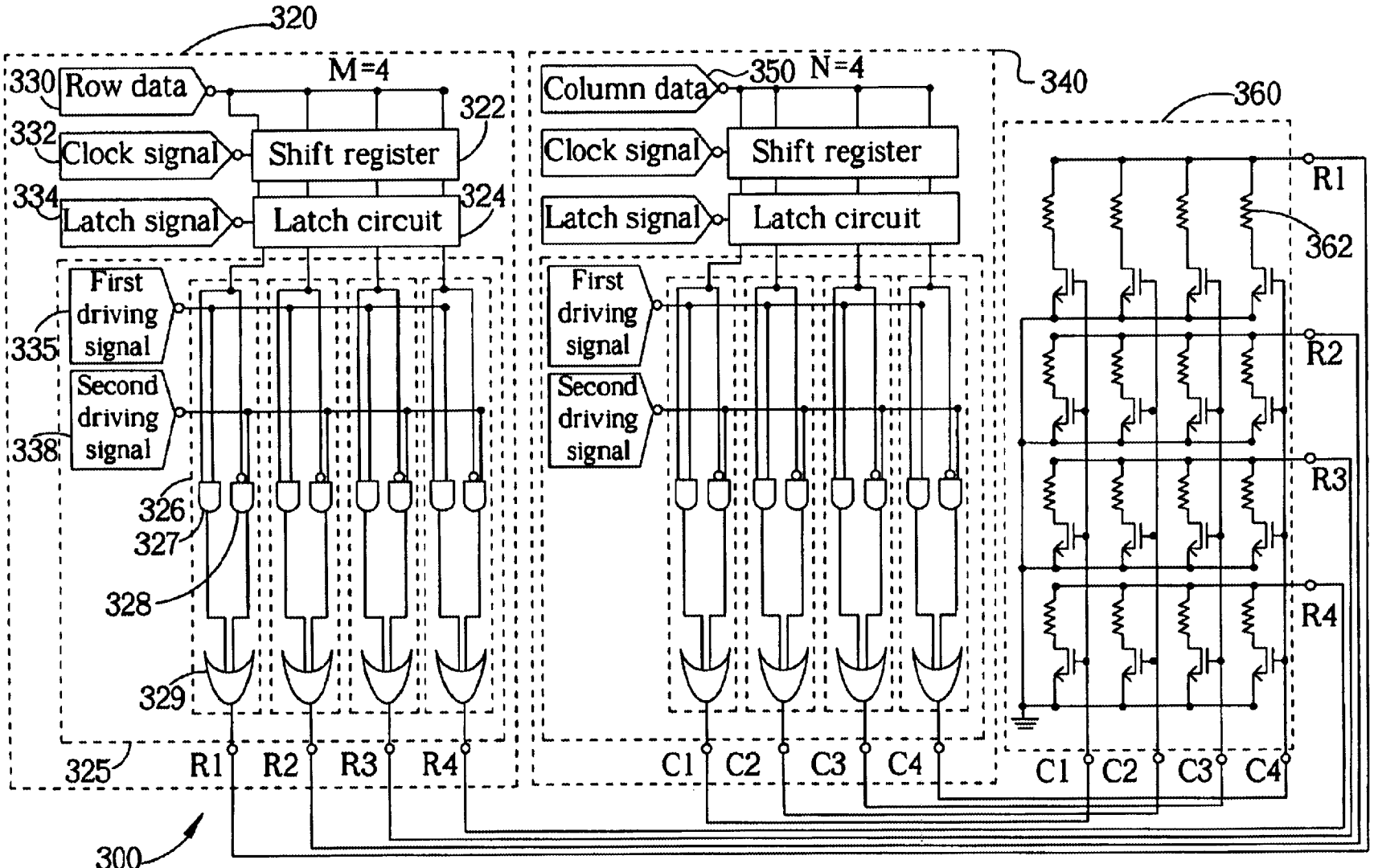
FIG. 7 is a diagram of the third preferred embodiment of the present invention ink jet print head driving circuit.

Please refer to FIG. 7. FIG. 7 is a diagram of a third preferred embodiment of the present invention inkjet print head driving circuit 300. The elements of the driving circuit 300 in FIG. 7 are almost the same as elements of the driving circuit 100 in FIG. 4. The only difference is in a design of the driving signal generator 325. As the operations of the row driving module 320 are similar with the operations of the column driving module 340, only the operations of the row driving module 320 are described. The driving signal generator 325 comprises a plurality of pulse width selection units 326. Each pulse width selection unit 326 has three input sources: printing data stored in the latch circuit 324, the first driving signal 335, and the second driving signal 338. Each pulse width selection unit 326 comprises a first AND gate 327, a second AND gate 328, and an OR gate 329. The inputs of the first AND gate 327 are the printing data and the first driving signal 335. The inputs of the second AND gate 328 are inverted printing data and the second driving signal 338. The inputs of the OR gate 329 are the output of the first AND gate 327 and the output of the second AND gate 328. A corresponding column or row control signal (R1,R2,R3,R4,C1,C2,C3,C4) is generated at the output of the OR gate 329 to output to the heating circuit 360 of the ink jet print head.

Figure 8:
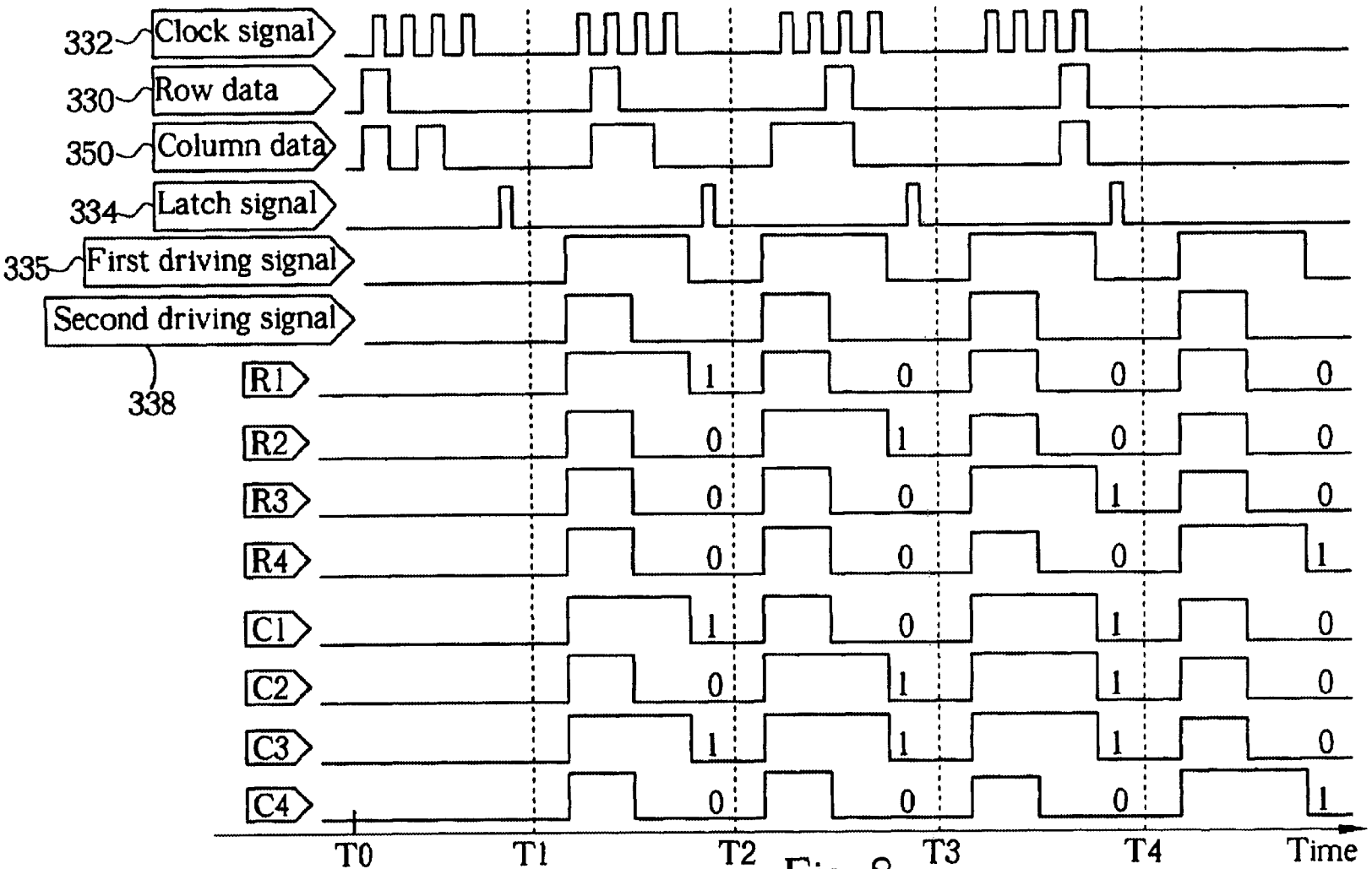
FIG. 8 is a timing diagram of the third preferred embodiment of the present invention ink jet print head driving circuit.

Please refer to FIG. 8. FIG. 8 is a timing diagram of the third preferred embodiment of the present invention inkjet print head driving circuit. In the preferred embodiment, the first driving signal 335 and the second driving signal 338 are both voltage pulses, and the magnitudes of the voltage pulses are the same. However, the pulse width of the first driving signal 335 is wider than the pulse width of the second driving signal 338. Thus, the energy supplied by the first driving signal 335 is greater than the energy supplied by the second driving signal 338. In other words, the energy supplied by the first driving signal 335 and the second driving signal 338 are different because the pulse widths are different. Therefore, in the preferred embodiment, both pulse widths must be designed suitably, so that the energy supplied by the first driving signal 335 is greater than the threshold energy to make the nozzle jet ink, and the energy supplied by the second driving signal 338 is less than the threshold energy, so that the temperature of the ink in the ink jet cells does not exceed the threshold, and the nozzles do not jet ink.

Figure 9:
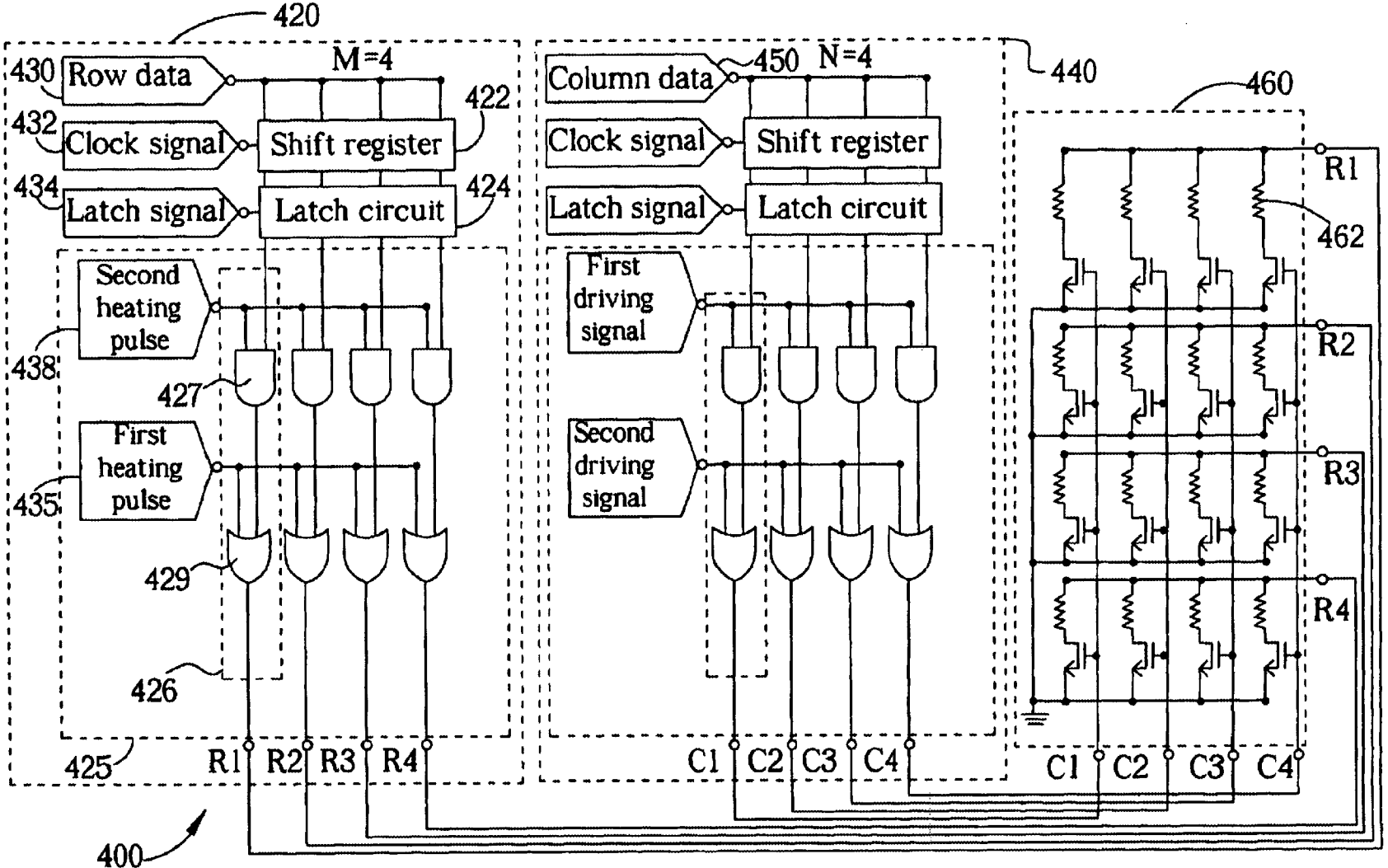
FIG. 9 is a diagram of the fourth preferred embodiment of the present invention inkjet print head driving circuit.

Please refer to FIG. 9. FIG. 9 is a diagram of a fourth preferred embodiment of the present invention ink jet print head driving circuit 400. The elements of the driving circuit 400 in FIG. 9 are almost the same as those of the driving circuit 100 in FIG. 4. The only difference is that the elements of the driving signal generator 425 of the driving circuit 400 and the elements of the driving signal generator 125 of the driving circuit 100 are different. As the operations of the row driving module 420 are similar to the operations of the column driving module 440, only the operations of the row driving module 420 are described. The driving signal generator 425 comprises a plurality of heating pulse generating units 426. Each pulse generating unit 426 has three input sources: printing data stored in the latch circuit 424, the first heating pulse 435, and the second heating pulse 438. The pulse generating unit 426 comprises an AND gate 427 and an OR gate 429. The inputs of the AND gate 427 are the printing data and the second heating pulse 438. The inputs of the OR gate 429 are the output of the AND gate 427 and the first heating pulse 435. A corresponding column or row control signal (R1,R2,R3,R4,C1,C2,C3,C4) is generated at the output of the OR gate 429 to output to the heating circuit 460 of the ink jet print head.

Figure 10:
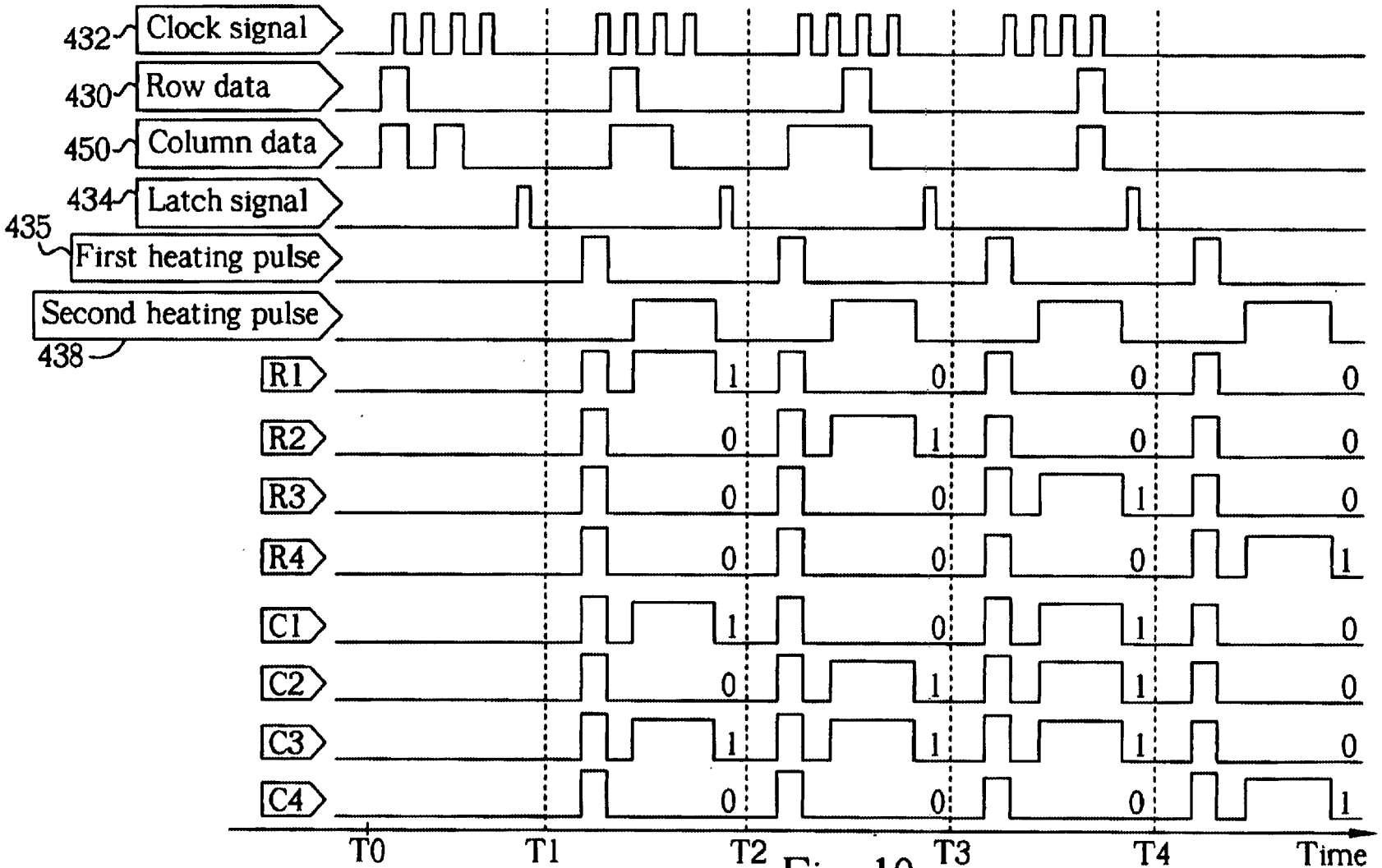
FIG. 10 is a timing diagram of the fourth preferred embodiment of the present invention ink jet print head driving circuit.

Please refer to FIG. 10. FIG. 10 is a timing diagram of the fourth preferred embodiment of the present invention ink jet print head driving circuit. In the preferred embodiment, the first heating pulse 435 is a preheat pulse, which preheats all ink jet cells regardless of whether they will jet ink or not. As the energy supplied by the first heating pulse 435 is less than the threshold, the nozzles are heated, but do not jet ink. Only the ink jet cells intended to jet ink receive heating by the second heating pulse 438. When the ink jet cells intended to jet ink receive heating by the first heating pulse 435 and the second heating pulse 438 at the same time, the total received energy exceeds the threshold, so that the nozzles jet ink.

Figure 11:
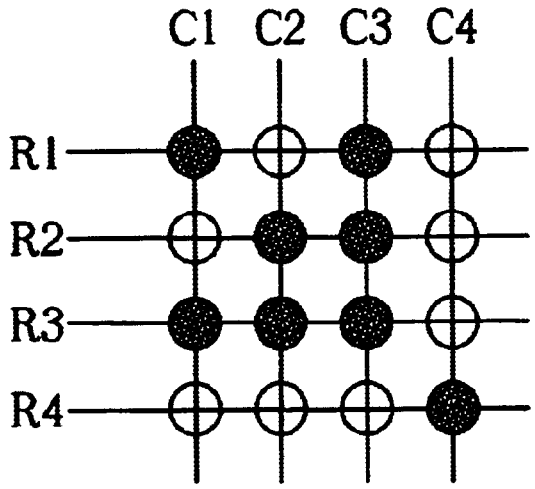
Fig. 11 Prior art
FIG. 11 is a diagram of a state occurring after the prior art ink jet print head driving circuit heats the ink jet print head.
Figure 12:
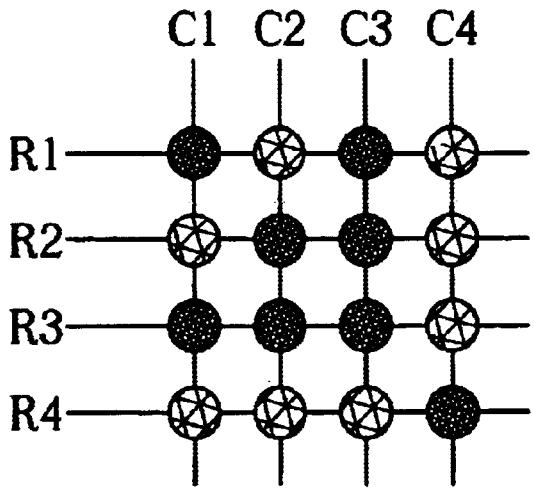
FIG. 12 is a diagram of a state occurring after the present invention ink jet print head driving circuit heats the ink jet print head.

Please refer to FIG. 11 and FIG. 12. FIG. 11 is a diagram of a state occurring after the prior art ink jet print head driving circuit heats the ink jet print head. FIG. 12 is a diagram of a state occurring after the present invention ink jet print head driving circuit heats the ink jet print head. From FIG. 11, after the prior art ink jet print driving circuit heats the ink jet print head, only the ink jet cells intended to jet ink are heated, as shown by the dark circles. But, the ink jet cells intended not to jet ink are not heated, as shown by the white circles. As mentioned above, the driving method of driving the prior art ink jet print head is susceptible to causing the ink spots to be of different sizes. In FIG. 12, after heating the ink jet print head with the present invention ink jet print head driving circuit, the ink jet cells intended to jet ink are heated in a way similar to the prior art, as shown by the dark circles. However, the ink jet cells intended not to jet ink are heated only moderately, as shown by the checkered circles. In this way, as each ink jet cell in the ink jet print head is heated moderately, heat distribution is more balanced, so that the jetted ink spots are of more uniform size.

According to the prior art, only the ink jet cells intended for jetting ink are driven with the first driving signal, and provided with energy to be heated, but no driving signal is provided to the ink jet cells not intended for jetting ink, so they are not heated. In contrast, the present invention driving circuit drives the ink jet cells not intended to jet ink with the second driving signal, which has less energy, yet provides energy to heat the ink jet cells. So, the heat distribution is more balanced, and the jetted ink spots are of more uniform size. However, as mentioned above, the size of the ink spots is related not only to the supplied energy, but also to whether the ink jet cells are previously heated. If an ink jet cell was heated recently, according to energy accumulation, the energy of ink in these recently heated ink jet cells is greater. If these cells are still driven with the fixed second driving signal and provided with a fixed energy to be heated, then the accumulated energy of the inkjet cells may exceed the threshold and cause the ink jet cells not intended for jetting ink also to jet ink. In this way, the printed data is still erroneous.

To avoid this problem, a temperature sensing feedback system is added in each of the above preferred embodiment driving circuit to dynamically sense temperature of the inkjet cells. When the temperature of the inkjet cells raises due to accumulation, the energy provided by the second driving signal is reduced moderately to avoid ink jetting inappropriately.

Figure 13:
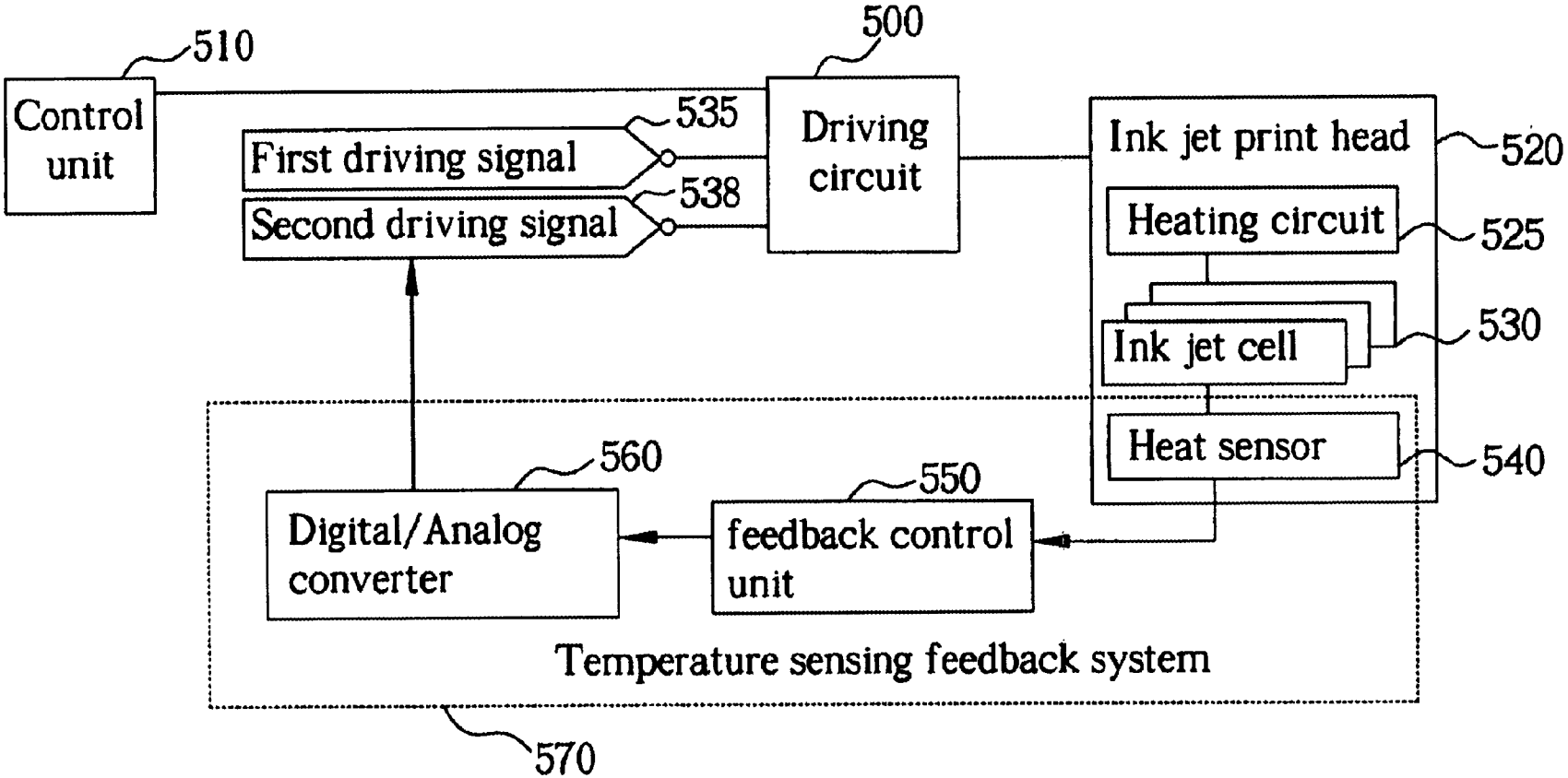
FIG. 13 is a function block diagram of the present invention ink jet print head driving circuit matching temperature sensing feedback system.

Please refer to FIG. 13. FIG. 13 is a function block diagram of the present invention ink jet print head driving circuit matching temperature sensing feedback system 570. The driving circuit 500 is controlled by the control unit 510 to drive the heating circuit 525 of the ink jet print head 520 to heat each inkjet cell 530. Each inkjet cell 530 jets ink to perform printing according to the clock signal. The driving circuit 500 is one of the driving circuits 100, 200, 300, or 400 from the above descriptions of the present invention preferred embodiments. The driving circuit 500 can also determine to drive each ink jet cell 530 in the ink jet print head 520 with the first driving signal 535 or the second driving signal 538, according to the printing data transmitted from the control unit 510 of the printing device. The temperature sensing feedback system 570 comprises a heat sensor 540, a feedback control unit 550, and a digital/analog converter (DAC) 560. The heat sensor 540 can be a common thermistor to sense the temperature of the ink jet cells 530. The feedback control unit 550 is electrically connected to the heat sensor 540, dynamically determines the change of the second driving signal according to the temperature sensed by the heat sensor 540, and produces a digital second driving signal reference value. The DAC 560 converts the second driving signal reference value produced by the feedback control unit 550 to an analog second driving signal 538, which can actually drive the circuit element. Because the second driving signal 538 can dynamically change according to the temperature of the ink jet cells 530, the feedback control unit 550 reduces the second driving signal and its energy when the temperature sensed by the heat sensor 540 rises. Thus, the nozzles not intended to print will not erroneously jet ink due to inappropriate overheating.

As each ink jet cell 530 is controlled by the driving circuit 500 respectively, the change of the temperature is not uniform. Each ink jet cell has a corresponding heat sensor 540, so that the feedback control unit 550 can adjust the second driving signal 538 against the change of the temperature of each inkjet cell 530. Of course, this increases the complexity of the technology required to make the ink jet print head, and the cost is raised. To have simultaneously the advantages of temperature sensing and feedback control without increasing the complexity and cost of the manufacturing technology, a single thermistor can be used to coil all ink jet cells 530. The thermistor is used to measure the average temperature of all ink jet cells 530. When the average temperature raises, the energy supplied by the second driving signal must reduce, so the feedback control unit 550 adjusts the second driving signal provided to each inkjet cell 530 to reduce the supplied energy. Thus, the method of measuring the average temperature can accommodate accuracy and cost requirements.

Those skilled in the art will readily observe that numerous modifications and alterations of the device may be made while retaining the teachings of the invention. Accordingly, the above disclosure should be construed as limited only by the metes and bounds of the appended claims.

What is clamed is:

1. A driving circuit for driving an ink jet print head of a printing device to print data onto a medium, the driving circuit having a plurality of nozzles and corresponding hearing elements, the driving circuit being capable of individually providing energy to the heating elements such that the nozzles are capable of jetting ink drops onto the medium, the driving circuit comprising:

a latch for latching and storing data; and a driving signal generator for providing a first driving signal and a second driving signal to heat a first set of the heating elements and a second set of the heating elements respectively, the driving signal generator comprising:

a multiplexer having at least one selection unit for providing the first driving signal and at least one selection unit for providing the second driving signal both according to data received from the latch;

wherein when the first set of the heating elements receives the first driving signal and simultaneously the second set of the heating elements receives the second driving signal, the first set of the heating elements will be heated to a level above a threshold so as to cause corresponding nozzles to jet ink drops onto the medium, and the second set of the heating elements will be heated to a level below the threshold so as to avoid corresponding nozzles from jetting ink drops onto the medium.

2. The driving circuit of claim 1 wherein the driving circuit further comprises a shift register for sequentially receiving the data from the printing device.

3. The driving circuit of claim 2, wherein the driving signal generator further comprises a starter for passing the first driving signal or the second driving signal to the heating elements according to a start signal to heat corresponding heating elements.

4. The driving circuit of claim 3, wherein the starter comprises a plurality of switching elements connected to the corresponding selection units of the multiplexer; wherein when a switching element receives the start signal, the switching element passes the first driving signal or the second driving signal received from the selection unit to the corresponding heating elements.

5. The driving circuit of claim 1, wherein each of the heating elements is a heating resistor set inside a corresponding ink jet cell for heating ink within the ink jet cell.

6. The driving circuit of claim 5, wherein the ink jet print head further comprises an ink tank connected to the plurality of ink jet cells, ink in the ink tank being sent to the plurality ink jet cells through a plurality of channels.

7. The driving circuit of claim 1, wherein the printing device is an ink jet printer, a copy machine, or a fax machine.

8. The driving circuit of claim 1, wherein the first driving signal and the second driving signal are both voltage pulses, and a voltage of the first driving signal is higher than a voltage of the second driving signal so that energy provided by the first driving signal is greater than energy provided by the second driving signal.

9. The driving circuit of claim 1, wherein the driving signal generator comprises a plurality of pulse width selection units, each of the pulse width selection units selectively outputting the first driving signal or the second driving signal according to the data.

10. The driving circuit of claim 9, wherein the first driving signal and the second driving signal are both voltage pulses, and a pulse width of the first driving signal is wider than a pulse width of the second driving signal so that energy provided by the first driving signal is greater than energy provided by the second driving signal.

11. The driving circuit of claim 1, wherein the first driving signal having a preliminary heating pulse and a heating pulse, the second driving signal having only the preliminary heating pulse.

12. The driving circuit of claim 1 further comprising a temperature sensing feedback system, the temperature sensing feedback system comprising:

a heat sensor for sensing a temperature of each heating element; and a feedback control unit electrically connected to the heat sensor, the feedback control unit being capable of adjusting the second driving signal according to the temperature;

wherein when the temperature sensed by the heat sensor exceeds a predetermined value, the feedback control unit reduces energy provided by the second driving signal so as to avoid the second set of nozzles from jetting ink when the second set of nozzles are overheated.

13. The driving circuit of claim 12, wherein the heat sensor is a thermistor.

14. The driving circuit of claim 1 wherein the first and second selection units of the multiplexer each comprise an AND gate, the first driving signal and data received from the latch being input into the AND gate of the first selection unit, and the second driving signal and inverted data received from the latch being input into the AND gate of the second selection unit; the multiplexer further comprising an OR gate having inputs connected to outputs of the AND gates of the first and second selection units for providing the first driving signal or the second driving signal to the heating elements.

* * * * *